United States Patent [19]

Mahoney et al.

[11] 4,372,227

[45] Feb. 8, 1983

[54] METHOD OF REDUCING HIGH TEMPERATURE SLAGGING IN FURNACES

[75] Inventors: Dennis F. Mahoney, Three Bridges; Alfred E. Kober, Bridgewater, both of N.J.; Subhash H. Risbud, Champaign, Ill.

[73] Assignee: Economics Laboratory Inc., St. Paul, Minn.

[21] Appl. No.: 233,064

[22] Filed: Feb. 10, 1981

[51] Int. Cl.[3] ..... F23B 7/00; C10L 9/02

[52] U.S. Cl. ..... 110/342; 44/4; 44/5; 110/343

[58] Field of Search ..... 44/4, 5; 110/342, 343

[56] References Cited

U.S. PATENT DOCUMENTS

| | | | |
|---|---|---|---|
| 1,828,839 | 10/1931 | Hawke | 110/343 |
| 1,894,682 | 1/1933 | Haas | 44/4 |
| 2,436,002 | 2/1948 | Williams | 110/342 X |
| 4,256,703 | 3/1981 | Dixit et al. | 44/5 X |

FOREIGN PATENT DOCUMENTS

| | | | |
|---|---|---|---|
| 714846 | 8/1965 | Canada | 110/343 |

*Primary Examiner*—Carl F. Dees

*Attorney, Agent, or Firm*—James & Franklin

[57] ABSTRACT

Slag buildup in high-temperature areas of a furnace system is minimized by adding to the molten ash particles carried by the flue gas a conditioner which is taken up by those molten particles and produces a nucleating effect when those particles cool, causing them to solidify more rapidly, thereby preventing deposit formation or resulting in considerably more friable deposits.

8 Claims, No Drawings

METHOD OF REDUCING HIGH TEMPERATURE SLAGGING IN FURNACES

The present invention relates to minimizing the buildup of slag in high-temperature areas of a furnace system. This is accomplished by adding to the ash-laden flue gas which produces the slag buildup a conditioning agent which fosters rapid solidification of the molten ash under prevailing temperatures. As a result, the solid ash is predominantly crystalline and is less liable to deposit, or, if it does it is readily removed from the furnace surfaces rather than producing large accretions of buildup on those surfaces.

Slagging occurs in all furnace systems. Some slag buildup on the inner walls of the furnace is often desirable in order to provide thermal insulation and thus minimize heat loss through the furnace walls, but excessive slag buildup tends to clog the furnace and/or produce excessive temperatures within the furnace.

While slagging problems may occur in connection with all types of fuel, as a practical matter, the problems are particularly acute when coal is the fuel in question, and it is to the control of coal slagging problems that the present invention is directed. The use of coal as a source of energy, particularly for the generation of electric power, can be expected to increase in the future, for economic reasons (the increasing cost of fuel oil) as well as for long term energy policy reasons (making the nation less dependent on imported sources of energy). Coal is not a uniform product—coal supplies from different natural sources have different compositions, different combustion characteristics, and different propensities toward producing slag, and in particular have different ash contents and different ash compositions. Ash content and the composition of the ash greatly affect the tendency to slag production.

Furnaces can be designed to be used with specific types of coal in order to minimize the adverse effects that those coal species might engender, but there is no single furnace design suitable for all possible coals. Increased demand for coal will make it increasingly difficult for utilities to obtain supplies of coal similar to those for which specific boilers were designed. In addition, increasingly stringent environmental regulations regarding sulfur dioxide emissions have already caused many utilities to switch to sources of low sulfur coal despite the fact that their boilers were specifically designed to be used with quite different types of coal. In many cases these low sulfur coals are completely different from the design coal with regard to ash fusion temperature, ash composition, ash content and the like. Substitution of coal with ash characteristics significantly different from those for which a given boiler was designed can give rise to problems in slagging and fouling. Formation of both types of deposits depends on ash composition and content.

Boiler slagging occurs when hot, molten or semi-molten ash particles strike and adhere to furnace surfaces in the radiant section of the boiler. Fouling occurs in the lower temperature convective sections of the boiler when volatile constituents in the ash such as the alkali oxides condense and collect further ash which then sinters into a hard mass. It is to slagging, and more particularly to the minimization thereof, that the present invention is directed.

The ash produced during combustion is classified according to the way in which it is removed from the boiler. Fly ash is that portion which is entrained in the flue gas and subsequently removed by air pollution control devices such as electrostatic precipitators. Bottom ash, as its name implies, remains in the boiler and is removed through the bottom of the firebox. Boilers are designed to remove this ash as either a molten, flowing slag or a dry, friable ash. Those designed for molten slag removal are known as wet bottom boilers while those designed for solid ash removal are known as dry bottom boilers. It is of critical importance to efficient boiler operation that the ash be in the physical state for which the unit was designed. U.S. Pat. No. 4,057,398 of Nov. 8, 1977, assigned to the assignee of this patent, deals primarily with the problems associated with the high melting ash in wet bottom boilers. The instant invention is directed towards substantially the opposite problem: to wit, the slagging tendencies of low melting ash in dry bottom boilers. Hence the solution of the slagging problems presented here involves a different approach from that taught in the aforementioned U.S. Pat. No. 4,057,398.

The mechanism of slag deposit formation in the boiler is believed to be as follows: Individual ash particles are in a molten or plastic state as they pass through the flame zone. If the ash then strikes the furnace walls in this state, it will be sticky and tend to form a solid, substantially homogeneous buildup. This buildup may then solidify to a hard, glassy deposit which strongly resists removal. It is these solidified deposits which normally strongly resist removal, and which constitute the major deleterious effect of slagging.

The accumulations of hard slag which result from the impaction of the plastic ash particles on upper furnace walls and spray heat tubes and hangers have a major effect on boiler operation, since they result in partial blockage of the gas flow, necessitating reductions in boiler load. In some cases slag may build up to the extent that damage to lower waterwall tubes can result from dislodging heavy accumulations. Another effect of slagging in the boiler is insulation of the waterwall tubes in the radiant section which leads to thermal imbalance within the boiler. As the waterwalls become insulated by slag accumulation, heat transfer efficiency decreases, and temperatures in the firebox become excessively high. This leads in turn to increased slagging as the problem becomes self-perpetuating. Because of the increased insulative effect temperatures in the convection passes also rise as do economizer outlet temperatures which can be used as a measure of the extent of slagging.

In the past, attempts to control furnace slagging have involved mechanical actions such as additional soot-blowing or changing the excess air level. Coals which are fairly high in iron content show significant increases in ash fusion temperatures when subjected to an oxidizing atmosphere in the boiler, and sometimes slag can be reduced by employing high excess air levels. The most universal method of correcting slagging conditions is, however, simply to reduce load. At reduced load, temperatures throughout the boiler are lower, molten ash solidifies faster, and slagging conditions are minimized. While reduction in load is an effective solution to the slagging problem, it is economically undesirable for the obvious reason that exceedingly expensive equipment is not being used to maximum capacity. Power purchased to meet operating requirements can be very expensive.

In addition to mechanical solutions to slagging problems, chemical solutions have also been proposed, dealing primarily with the use of substances which modify the fusion temperature of the ash. Typical of these is the aforementioned U.S. Pat. No. 4,057,398 which describes additives used to lower ash fusion points. The converse problem of raising ash fusion points is not so easily handled. For some coals a small (commercially practicable) amount of additive can produce a relatively large increase in ash softening temperature which by itself may be sufficient to alleviate slagging. This is particularly true of ashes having a very low or a very high basic content. For ash having an average composition of 30–40% basic components, or other ash resisting the effect of those additives which change the softening temperature, such a high amount of additive is required as to make the conditioning process economically impractical, and sometimes the additive, in the amount it must be used, itself contributes to buildup of deposits within the furnace system, in the cooler sections thereof if not in the high temperature sections thereof.

One commonly used measure of slagging occurrences is the ASTM fusion test. In this test small cones of ash particles are heated and the temperatures of various degrees of deformation noted. Our investigations brought us to the realization that the observable softening temperature of the ash was in many instances not the controlling characteristic thereof insofar as slag production is concerned. The ash particles, we discovered, after being made molten, would upon recooling remain molten to temperatures well below their normal melting temperature, and they would then strike the boiler surfaces while still molten and harden into amorphous glassy solids which would be very tough and removal-resistant. The fact that they supercooled before solidifying meant that deposits would remain molten within the furnace for longer periods of time, thus permitting additional particles to be caught by the molten deposit mass, thereby increasing the speed and amount of buildup, while the dense state of the solidified mass made it exceedingly difficult to remove.

We have found that there are certain substances which, when combined with the molten ash, will have the characteristic of minimizing the supercooling tendency of the untreated particles and thus accelerate the particle solidification into a crystalline material rather than as amorphous, glassy mass.

While the mechanism involved is not fully understood, we theorize that these substances, when combined with the molten ash, do not themselves completely dissolve into the molten mass but retain their solid nature, and that they then serve as nucleating agents during the cooling of the ash particle, causing that particle to solidify at a temperature quite close to its normal melting temperature and fostering its solidification into a crystalline form. More specifically, we have found that the addition of particles of alumina, silicon carbide or aluminum nitride are extremely effective in this regard.

We have further observed a very surprising attribute of these materials when combined with molten coal ash to minimize slagging, to wit, the fact that, for reasons not presently understood, the effectiveness of these products in reducing slagging is very significantly enhanced, to the point of making economically practical what theretofore was utterly impractical, by introducing those conditioning substances into the furnace system after the flame zone and at or upstream of those sections of the furnace system where slag buildup tends to occur. Field trails of alumina, which is by far the least expensive of the aforementioned materials, were carried out in 1977 at an electric generation installation then experiencing severe slagging problems with coal having an ash content of about 12%, the conditioner being applied to the coal before it was pulverized and burned. A very significant improvement in slagging conditions resulted. Thereafter the compositions in question were offered for sale by the assignee of this application, but not a single sale was made, not even to the utility where the effectiveness of these materials to reduce slagging had been demonstrated, because the amounts of such materials which had to be added in order to produce meaningful anti-slagging results were so great as to make the process economically unfeasible. This situation continued for over two years, with the product being promoted, but with the prospective customers refusing to buy because it simply did not make economical sense.

We then discovered that if these conditioning materials were to be injected into the furnace system in the firebox area, downstream of the flame area and at or upstream of the high temperature (often 2000°–2600° F.) region of the boiler system where slagging tends to occur, we not only achieved the same or better slagging-reduction effects, but did so with significantly less additive, even though the coal being burned in a particular field test had an ash content of 22.2%, almost twice that of the coal involved in the earlier field trails, thereby converting an economically impractical method into one which was economically very valuable. The injection of the additive into the firebox had the further advantage of enabling the process to be used with a furnace system that had slag already present (whereas the coal-applied method of the earlier field trial appeared to require a comparatively clean furnace system to start with). Indeed, we have discovered that with firebox injection of the additive, intermittent feed of the additive, even commencing after the onset of slagging, is effective in slag control and cleanup, thus further reducing the amount of additive required. Simply by way of comparison, the applied-to-coal experiment of 1977 involved the use of about 20 pounds of conditioner per ton of coal having about a 12% ash content, or about 8.35% by weight of the ash, whereas a utility field test of the firebox-injection method involved the use of about 8 pounds of additive per ton of coal having a 22.2% ash content, or about 1.8% by weight of the ash, and when intermittent or pulsed feed was employed the amount went down to less than 3½ pounds per ton of that coal, or about 0.8% by weight of the ash.

The additive (alumina, silicon carbide or aluminum nitride or combinations thereof), is preferably introduced into the furnace in finely divided form, but it could be introduced as a liquid which spray dries to a powder, as a slurry, or as a solution of another chemical which, under the conditions to which it is exposed, will react to form alumina, silicon carbide or aluminum nitride. For example, aluminum formate will, in the presence of water, heat and oxygen, be converted to finely divided alumina.

The conditioner is added to the flue gas at or upstream of the high-temperature region in the boiler system where slagging tends to occur, but downstream of the combustion region proper, and usually in the firebox area. Temperatures in those injection regions may vary between 1600° F. and 3200° F., although temperatures of 2000°–2600° F. are generally involved.

The precise location of the injection points in a given installation will depend to a large extent upon the nature of the coal used and the physical characteristics of the installation, and some empirical trial-and-error testing may be required to determine the optimum injection point for any given furnace-boiler system.

Use of the conditioners here disclosed will not only greatly minimize slag buildup in initially clean boilers, and render readily removable such slag as does form, but is also effective, when injected into furnaces where slag has already built up, in preventing further slag buildup and in facilitating removal of the pre-existing slag after the conditioner has been used for a period of time.

A particularly significant advantage of the use of the conditioners here disclosed is that they can be used intermittently, the conditioner being injected for a period of time of about an hour or more at a rate considerably below that required to produce a comparable effect when the conditioner was added to the coal before combustion, then interrupting injection of the conditioner for another period of about an hour or more, and so on, while still achieving a very significant reduction in slag buildup. Thus the consumption of conditioner is very greatly reduced, and the economic feasibility of the process greatly enhanced.

In considering the amount of conditioner to be utilized, measurement in pounds per ton of coal burned is not a particularly meaningful statistic because coals vary so greatly in ash content and in the chemical composition of the ash. A more meaningful statistic is the amount of additive expressed in terms of percent by weight of the ash content of the coal. In the 1977 field trials described above, where the conditioner was applied to the coal before the coal was burned, the coal had an ash content of about 12%, and the conditioner was added at the rate of about twenty pounds per ton of coal. This translates into additive use of about 8.35% by weight of the ash content of the coal. It was that rate of use which was considered economically contra-indicated.

By way of contrast, in a 1980 field test with another boiler operating at full load (190 megawatts) where slag had already accumulated to the point that deration was imminent, and where the coal had a 22.2% ash content, the conditioner was introduced into the boiler firebox at a rate of about 4–6 pounds per ton of coal burned, and deration was avoided. This translates into a conditioner rate of 0.91–1.35% by weight of the ash content of the coal.

Thereafter in the same installation, the conditioner was fed at a rate of 4 pounds per ton of coal for about two hours, injection of the conditioner was terminated for a period as long as six and a half hours, during which period no deterioration was noted, and so on. This amounts to an overall usage of conditioner of only 0.21% by weight of the ash content of the coal.

In accordance with the present invention the conditioner can be provided at a rate of about 0.2–2.5% by weight of the ash content of the fuel, with a preferred range of 0.2–2.0% by weight, and with a highly preferred range of 0.2–1.5% by weight.

In the 1980 installation slagging presented a particular problem in the superheat area. In those field trails the conditioner was injected through two ports on the back wall of the furnace, at the same elevation as the top row of burners on the front wall, directly into the slagged area. The field tests showed that the conditioner was effective in significantly reducing the rate of buildup and made the slag deposits more friable and more easily removed by soot blowers.

The conditioners of the present invention do increase the melting point of the ash, but it is believed that that effect plays only a minor or secondary part in the effectiveness of the conditioners. Their efficacy can also be shown in laboratory tests. For example, use of the conditioner in an amount of 5–10% by weight of the ash results in a laboratory-measured increase in the melting temperature of the ash of about 100°–160° F., but, as has been indicated above, in accordance with the present invention the conditioners are used at much lower percentages, and it is believed that the increase in melting temperature of the ash produced by such low percentages of conditioner would not alone be significant in preventing slag buildup. What is of primary significance, it is believed, is the nucleating effect of the particulate conditioner, which not only minimizes the supercooling tendency of the particles but causes them to solidify into a crystalline rather than an amorphous mass, thus making them much more friable and easily removed. Because of the small change in liquidus temperature, the ASTM fusion test which measures melting behavior and is often used to indicate the slagging tendencies of coals is not a good measure of the effectiveness of these conditioners. Rather we believe that other methods such as differential thermal analysis (DTA) which measures both the liquidus and freezing points provide a better indication.

This belief is supported by the following experimental results:

A typical low iron fly ash has the composition $SiO_2$-50.6; $Al_2O_3$-22.0; $Fe_2O_3$-6.3; CaO-7.9; MgO-1.9; $Na_2O$-0.7; $K_2O$-0.2. Using differential thermal analysis (DTA), this ash is heated above its liquidus temperature of 2280° F. and then allowed to cool to room temperature. Unlike its melting behavior, the cooling behavior does not show a sharp freezing point at 2280° F. but supercools to an amorphous glass which finally solidifies at 1100°–1300° F. The glass structure is confirmed by electron diffraction analysis. Introduction of any of the materials, alumina, silicon carbide or aluminum nitride, at a level of 1–10 wgt.% does not greatly affect the melting point but does change the cooling behavior. A sharp solidification peak now occurs on the DTA at the melting point, and subsequent electron diffraction analysis indicates the melt forms a predominantly crystalline solid.

It will be apparent from the above that the instant method is not only highly effective in preventing slag buildup within a furnace-boiler combination, but does so by a mechanism (nucleation) which has not heretofore been advanced as a solution to that problem, and results in such a reduced usage of conditioner over what had previously been thought necessary as to make the process economically attractive and to eliminate the possibility that the conditioner itself might give rise to buildup problems.

It will be appreciated that many variations may be made in the specific steps of the process, all within the spirit of the invention as defined in the following claims.

We claim:

1. A method of ameliorating high-temperature slagging conditions which results from impaction on the boiler interior surfaces of molten or semi-molten ash particles in a flue gas resulting from the combustion of fuel, which method comprises (a) at or upstream of the high-temperature region in said boiler system where slagging tends to occur, but downstream of the combustion region proper, adding to said flue gas a conditioner comprising one or more finely divided substances from the group consisting of silicon carbide and aluminum nitride, and (b) thereafter causing said mixed flue gas and conditioner to flow through said region, whereby the cooled ash has a predominantly crystalline characteristic.

2. A method of ameliorating high-temperature slagging conditions which results from the impaction on previously slagged boiler interior surfaces of molten, semi-molten or solid ash particles in a flue gas resulting from the combustion of fuel, which method comprises (a) at or upstream of the high-temperature region in said boiler system where slagging tends to occur, but downstream of the combustion region proper, adding to said flue gas a conditioner comprising a substance one or more finely divided substances from the group consisting of silicon carbide and aluminum nitride, and (b) thereafter causing said mixed flue gas and conditioner to flow through said region, whereby the cooled ash has a predominantly crystalline characteristic.

3. The method of either claims 1 or 2, in which said conditioner is injected into said flue gas in the firebox area of said furnace system.

4. The method of claims 1 or 2, in which said conditioner is injected into said flue gas in a region where the temperature is around 1200°-3200° F.

5. The method of claims 1 or 2, in which said conditioner is provided at a rate of about 0.1-2.5% by weight of the ash content of said fuel.

6. The method of claims 1 or 2, in which said conditioner is provided at a rate of about 0.2-2.0% by weight of the ash content of said fuel.

7. The method of claims 1 or 2, in which said conditioner is provided at a rate of about 0.2-1.5% by weight of the ash content of said fuel.

8. The method of any of claims 1, 2 and 3-7 in which the conditioner is injected for a period of time of an hour or more, injection is terminated for a period of time of an hour or more, and so on.

* * * * *